US007172362B2

(12) United States Patent
Schmitt

(10) Patent No.: US 7,172,362 B2
(45) Date of Patent: Feb. 6, 2007

(54) DIVIDER BARRIER FOR ROADWAY DELINEATION

(75) Inventor: Karl-Heinz Schmitt, Tholey (DE)

(73) Assignee: SPIG Schutzplanken-Produktions-Gesellschaft mbH & Co. KG, Schmelz-Limbach (DE)

( * ) Notice: Subject to any disclaimer, the term of this patent is extended or adjusted under 35 U.S.C. 154(b) by 0 days.

(21) Appl. No.: 11/048,115

(22) Filed: Feb. 1, 2005

(65) Prior Publication Data

US 2006/0159516 A1 Jul. 20, 2006

(30) Foreign Application Priority Data

Jan. 20, 2005 (EP) ..... 05001119

(51) Int. Cl.
*E01F 13/00* (2006.01)

(52) U.S. Cl. ..... 404/6

(58) Field of Classification Search ..... 404/6; 256/13.1

See application file for complete search history.

(56) References Cited

U.S. PATENT DOCUMENTS 1,175,962 A * 3/1916 Latham ..... 405/31
3,308,724 A * 3/1967 Smith ..... 404/7
4,722,513 A * 2/1988 Gaillard et al. ..... 256/13.1
4,982,931 A * 1/1991 Pomero ..... 256/13.1
5,230,582 A * 7/1993 Schmitt et al. ..... 404/6
5,387,049 A * 2/1995 Duckett ..... 404/6

FOREIGN PATENT DOCUMENTS

DE 3816528 * 3/1989
DE 38 27 030 C2 4/1989
EP 0 472 847 B1 8/1994

* cited by examiner

*Primary Examiner*—Gary S. Hartmann
(74) *Attorney, Agent, or Firm*—Henry M. Feiereisen

(57) ABSTRACT

A divider barrier 1 for roadway delineation includes detachably juxtaposed divider members 2, 3, 4. The divider members have each a housing-like base body 5 which can be placed on the ground and has slanted roof-shaped lateral collision plates 6, 7. Connected to the lower longitudinal edges 10 of the collision plates 6, 7 are support plates 11, 12 which extend from the base body 5 outwards. A guide bar 15 is provided above the base body 5 at a vertical distance thereto. Connecting means 18–21 are provided to detachably couple successive divider members 2, 3, 4 with one another. The support plates 11, 12 of two successive divider members 2, 3, 4 are detachably connected to one another by means of fishplates 35 on the underside, wherein each fishplate 35 is hereby fixed with its first end portion 36 under the support plate 11 of the one divider member 2, 3, 4 and with its second end portion 37 under the support plate 12 of the following second divider member 2, 3, 4. Each of the first end portion 11 as well as the second end portion 12 of each fishplate 35 has a receiving opening 40 for engagement of a pin 41 constructed of round configuration and secured under each of the support plates 11, 12. As a consequence of these pins 41, the divider barrier 1 is stiffened against lateral displacement.

11 Claims, 8 Drawing Sheets

DIVIDER BARRIER FOR ROADWAY DELINEATION

BACKGROUND OF THE INVENTION

The invention relates to a divider barrier of steel for roadway delineation.

A prior art divider barrier comprised of butt-joined divider members is described in EP 0 472 847 B1 or also DE 38 27 030 C2 and predominantly provided for mobile use in construction sites, for example.

Known divider barriers have proven very useful and find application on many roadways in Europe. The divider barriers are very easy to assemble and to dismantle and provide very reliable roadway delineation with high restraining capacity. Depending on the approach angle, there may be occasions when the wheel of an impacting motor vehicle is unable to fully contact the lower support plates so that the weight of the vehicle fails to contribute to the fixation of the divider barrier on the roadway. As a result, the divider barrier may be displaced more severely to the side.

Further, divider barriers have to meet different requirements established by various countries of the European Union with respect to their containment level. This is especially true for construction sites.

Taking into account the continuously increasing safety requirements, there is a need to improve the divider barrier, to further increase its restraining capacity, and also to render it useful for stationary application.

SUMMARY OF THE INVENTION

On the basis of the prior art, the invention is thus based on the object to improve the application of a divider barrier, to increase the restraining capacity, and in particular to reduce a lateral displacement in the event of an impact.

This object is attained in accordance with the invention by a divider barrier which includes detachably juxtaposed divider members of steel. The divider members have each a housing-like base body which can be placed on the ground and has slanted roof-shaped lateral collision plates. Connected to the lower longitudinal edges of the collision plates are support plates which extend from the base body outwards. A guide bar is provided above the base body of a divider member at a vertical distance thereto and connected to the base body via vertical posts. Connecting means are provided to the ends of each base body and to each guide bar for attachment to neighboring base bodies and guide bars. The support plates of two successive divider members are detachably connected to one another by means of fishplates on the underside. Each fishplate is hereby fixed with a first end portion under the support plate of the one divider member and with its second end portion under the support plate of the following second divider member.

In accordance with the invention, each of the first end portion as well as the second end portion of a fishplate has a receiving opening. When the divider members are coupled to one another, a pin secured under each of the support plates engages in the receiving openings.

The pin realizes additional stiffening, in particular stiffening against lateral displacement of the divider barrier in the connection zone between two divider members. Yet, the divider barrier can be assembled and disassembled in usual manner. As a consequence of the reinforcement and stiffening of the butt joint between two divider members, the construction is able to attain higher containment levels, for example a containment level H3 according to the statutory test standard EN 1317, or comply with the requirements established by US regulations.

The use of a pin having round configuration has been shown especially advantageous in practice. Involved here is a massive circular blank of metal with a diameter of, for example, 50 mm to 60 mm. The diameter of the pin is significantly greater than the diameter of other screw fasteners otherwise used for assembly.

Suitably, the pin is constructed in the form of a cone section. This facilitates insertion in the receiving openings of a fishplate and thus assembly and disassembly operations.

Assembly can be further simplified by constructing the fishplates in symmetric relationship to their center transversal plane. The installation of the fishplates is thus independent on the arrangement of the receiving openings and on the position of the other threaded bores which assist in the securement of the fishplates upon the support plates. The fishplates can be used on the left as well as right side, i.e. on both sides of a divider member. The mirrored or symmetrical configuration of the fishplates also simplifies their manufacture.

In practice, a fishplate engages with one half of its length (first end portion) underneath the support plate of the first divider member and with the other half of its length (second end portion) underneath the support plate of the second divider member. The fishplates are secured to the support plates by means of screw bolts. The pins, too, are secured to the support plates by screw bolts. This is realized preferably via a stable screw bolt which is guided from the topside of the support plate through an opening in the support plate and threadably engaged in a threaded bore of the pin. The pin is hereby reliably and securely braced in the support plate.

By adjusting the play between pin and receiving opening, the two divider members can be angled to a limited degree in order to suit the installation situation of a divider barrier. This is desired, for example, at construction sites so that curves can be followed. In this context, it is provided to configure the diameter of the receiving opening greater than the diameter of the pin. The receiving openings thus have overmeasure in relation to the pins to thereby allow a limited angled relationship between the individual divider members and thus a curving of the divider barrier. In this respect, it is further provided to configure the assembly opening in the fishplates with overmeasure in relation to the screw bolts. Thus, the screw bolts are able to move to a limited extent in the assembly openings of the fishplates.

To further safeguard the divider barrier against transversal displacement, friction-increasing means can be provided on the underside of the base bodies. Preferably, the friction-increasing means are formed by single-piece shoes which formfittingly embrace from below stringers provided on the underside of the base bodies. The shoes are made of elastomer, especially rubber or polyurethane. In addition, the shoes oppose a heat conduction from the divider barrier to the roadway surface. As a result, adverse heating of the road pavement or roadway surface is prevented. At the same time, the standing area of the stringers is increased and thus the surface pressure on the roadway surface is decreased so that impressions can be avoided. In particular, the friction-increasing means comply with the demands for a slightest possible lateral displacement in the event of an impact.

DESCRIPTION OF THE DRAWING

The invention will now be described in more detail with reference to exemplified embodiments. It is shown in.

DETAILED DESCRIPTION OF PREFERRED EMBODIMENTS

Figure 1:
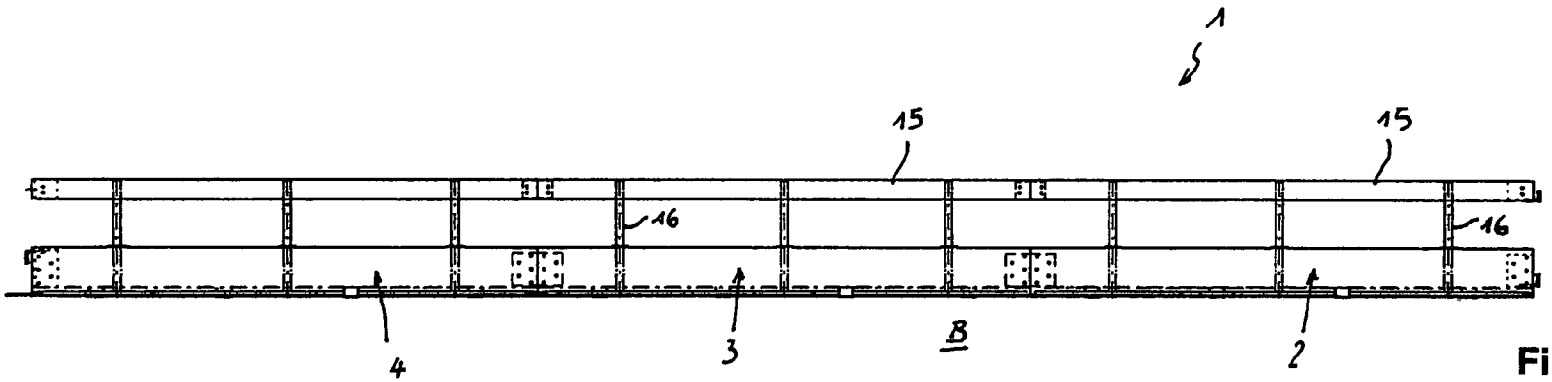
FIG. 1 a side view of a section of a divider barrier according to the invention.
Figure 2:
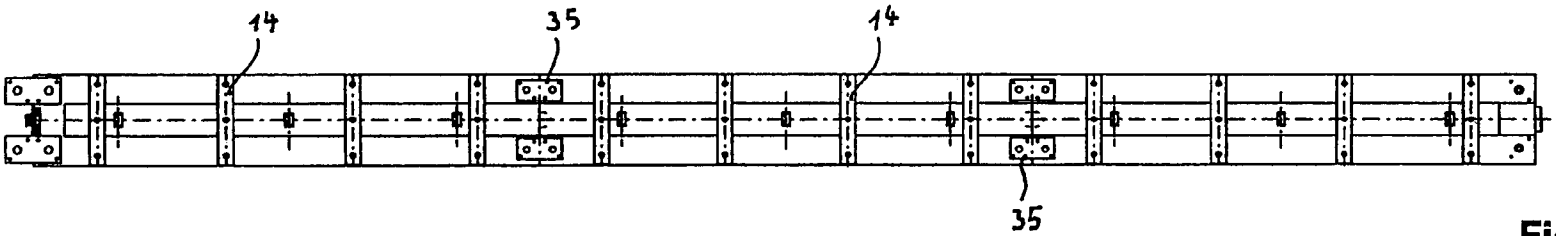
FIG. 2 a bottom view of the divider barrier of FIG. 1.

FIG. 1 shows a section of a divider barrier 1 of steel which is arranged as roadway delineation for example on a median strip between two lanes with two-way traffic.

The divider barrier 1 includes divider members 2, 3, 4 (see also FIGS. 4 to 6) which are detachably juxtaposed in longitudinal direction. Each divider member 2, 3, 4 has a housing-like base body 5 with slanted roof-shaped lateral collision plates 6, 7, a top plate 9 which connects the upper longitudinal edges 8 of the collision plates 6, 7, as well as the support plates 11, 12, which are connected in the form of flanges to the lower longitudinal edges 10 of the collision plates 6, 7 and extend from the base body 5 outwards. The marginal portions 13 of the support plates 11, 12 are slightly bent downwards. Bottom-side stringers 14, as shown in FIGS. 2 to 5, provide the support of the base bodies 5 of the divider members 2, 3, 4, on the ground.

Figure 6:
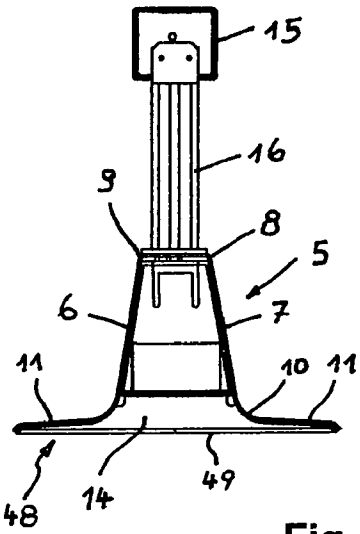
FIG. 6 a side view of the illustration of FIG. 4 according to arrow A.
Figure 7:
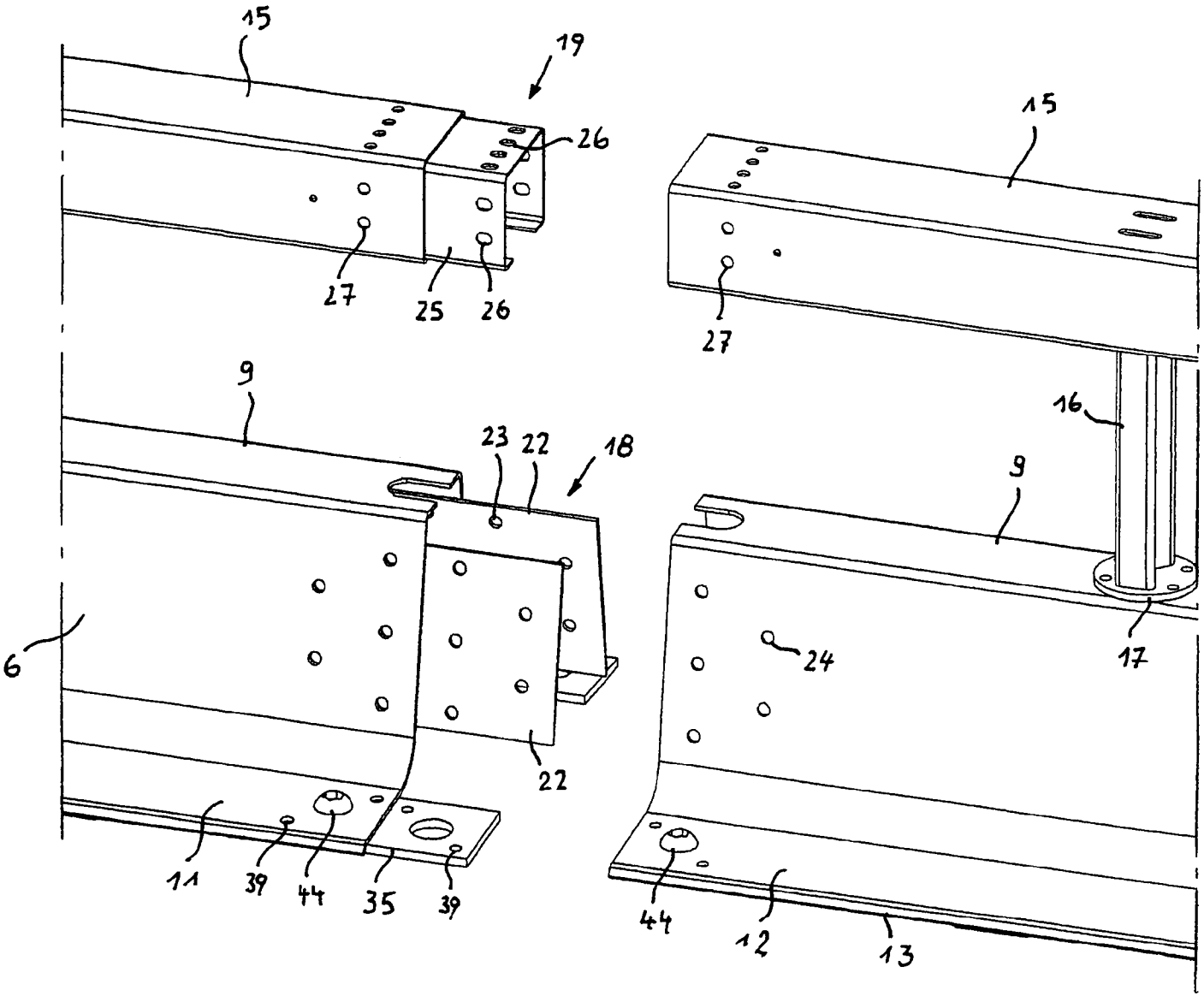
FIG. 7 a perspective representation of an end portion of two successive divider members before juxtaposition.
Figure 9:
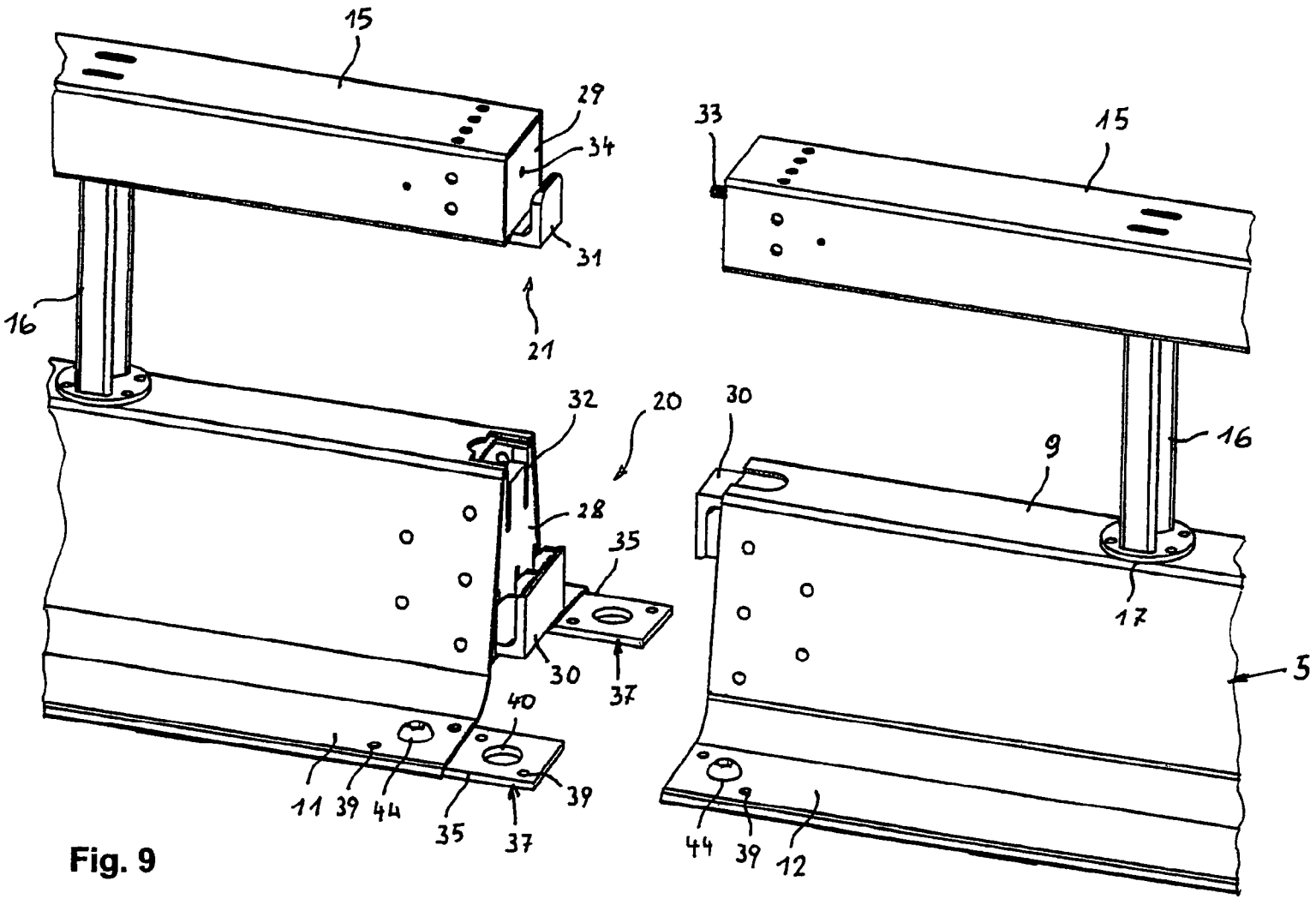
FIG. 9 again a perspective representation of an end portion of two successive divider members before juxtaposition.

Extending above the base body 5 at a distance thereto is a guide bar 15 in the form of a quadrilateral tube 15 or a downwardly open C-shaped section. The guide bars 15 are connected to the base body 5 by posts 16 of sigma-shape in horizontal cross section. The posts 16 are arranged in spaced-apart relationship to one another and distanced to the ends of the divider member 2, 3, 4. The posts 16 are welded together with disks 17 which are screwed onto the top plate 9. This is shown in FIGS. 6, 7, and 9. The posts 16 can also extend through the disks 17 and can be detachably or permanently secured inside the base body 5.

The divider members 2, 3, 4 are coupled together by connectors 18–21 in longitudinal direction. Each base body 5 and each guide bar 15 are hereby provided with respective connectors 18–21 for attachment to neighboring base bodies 5 and guide bars 15. Different connectors 18–21 may be used hereby for coupling the individual divider members 2, 3, 4.

Figure 4:
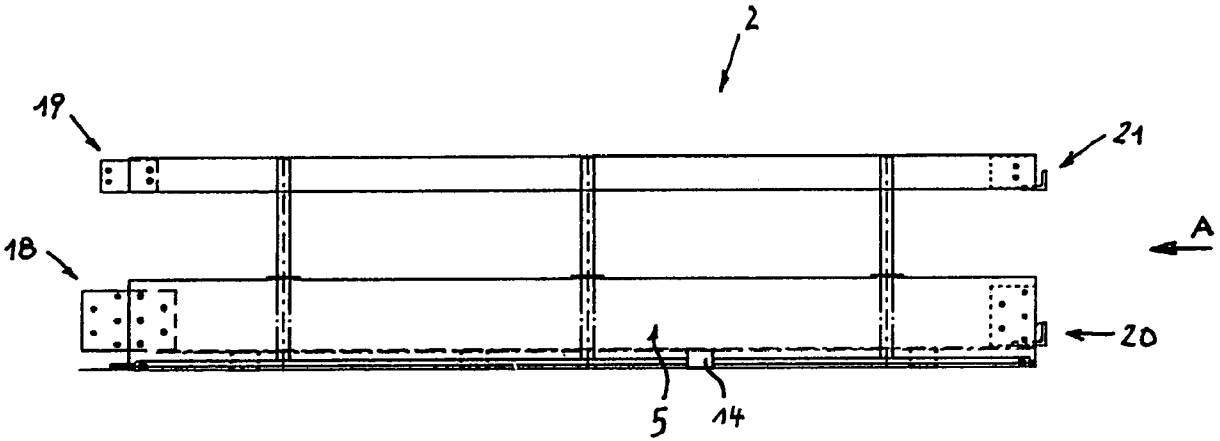
FIG. 4 a side view of a divider member.
Figure 5:
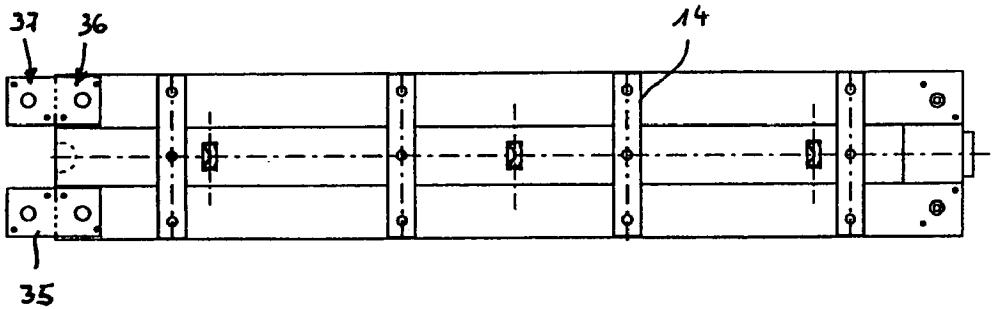
FIG. 5 a bottom view of the divider member of FIG. 4.
Figure 8:
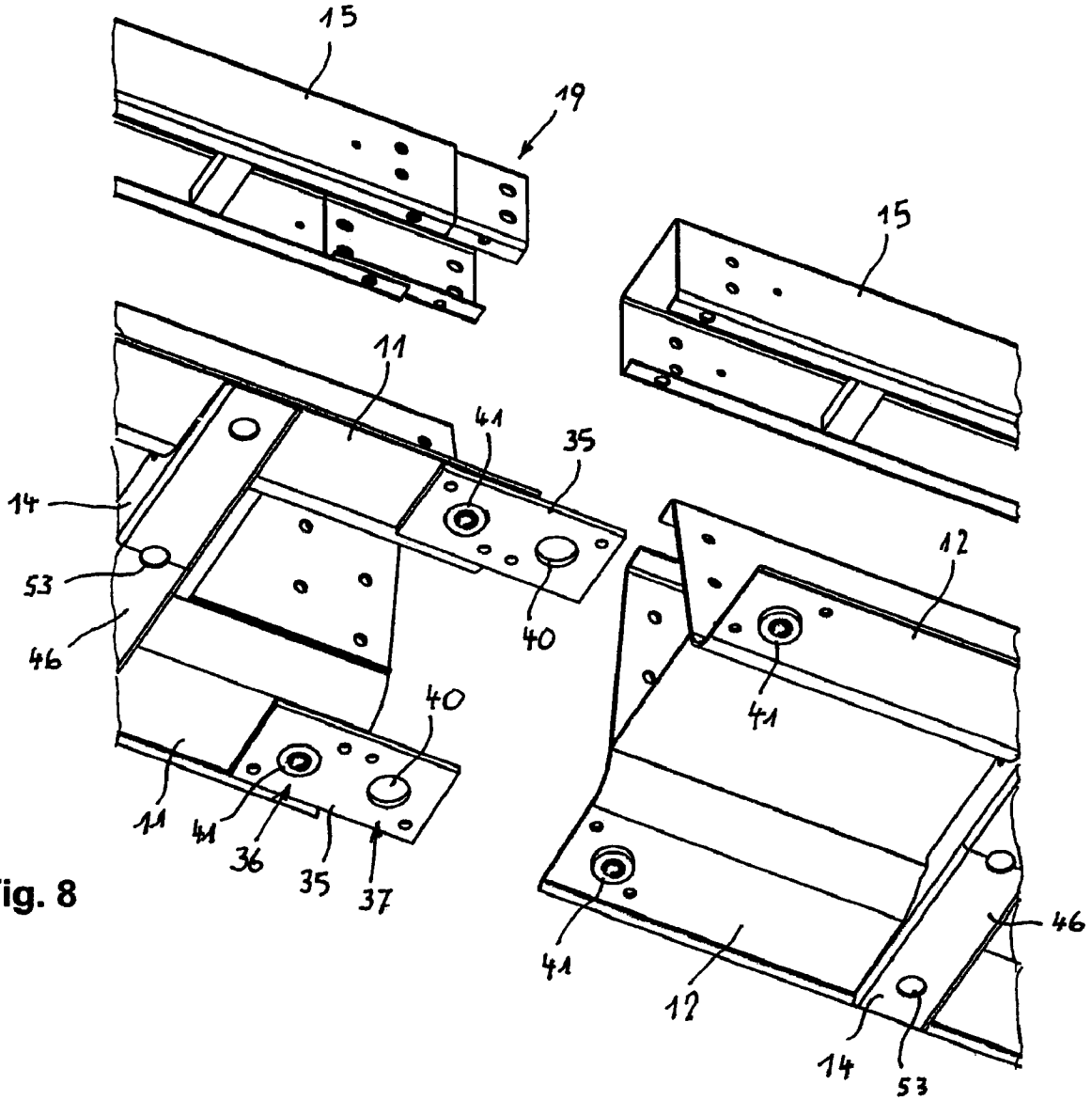
FIG. 8 also a perspective view from below upon the representation according to FIG. 8.

As shown on the left-hand side in FIG. 4, as well as in FIGS. 7 and 8, connectors 18 in the form of overlapping sheets 22 with a plurality of threaded throughbores 23 are used. The throughbores 23 correspond with respective bores 24 in the collision plates 6, 7. The overlapping sheets 22 are installed on the inside of the base body 5 adjacent to the collision plates 6, 7 and provide a stable, detachable connection.

The connectors 19 between the guide bars 15 are configured in the form of C-shaped overlapping pieces 25 with threaded throughbores 26 which are provided in the ends of the guide bars 15 and bridge the joining zone. Bores 27 in the guide bars 15 correspond with the threaded throughbores 26 to thereby allow coupling of the guide bars 15 by using screw fasteners. The screw fasteners as well as the associated nuts and washers are not shown in more detail.

The connectors 20, 21, shown in FIG. 4 in the drawing plane on the right end of the divider member 2 and in FIG. 9, include adapter pieces 28, 29 fixed in the ends of the base bodies 5 as well as of the guide bars 15. The adapter pieces 28, 29 have each a hook-shaped member 30, 31 and respectively mating receptacles 32 so that the divider members 2, 3, 4 with the hook-shaped member 30, 31 can be engaged in the receptacles 32 and coupled. The connection between two guide bars 15 can be additionally aided by a coupling stud 33 which is inserted through bores 34 in the end surfaces of the adapter pieces 28, 29 and assists the tension-proof and compression-proof connection of the guide bars 15.

Figure 3:
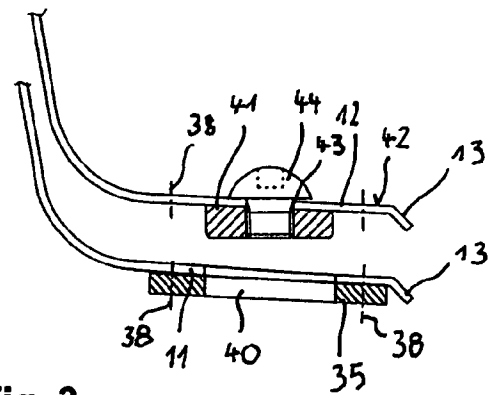
FIG. 3 a partial vertical section of a portion through the butt joint between two successive divider members.

As shown in particular in FIGS. 2, 3, 5, 7, 8, and 9, the support plates 11, 12 of two successive divider members 2, 3, 4 are detachably connected to one another by bottom-side fishplates.35. Each fishplate 35 is secured with a first end portion 36 underneath the support plate 11 of the one divider member 2, 3, or 4, and with its second end portion 37 underneath the support plate 12 of the following divider member 2, 3, or 4. Securement of the fishplate 35 is realized by screw fasteners 38, as indicated in FIG. 3, and assembly openings 39 in the fishplates 35 as well as the support plates 11, 12.

Provided in the first end portion 36 as well as also in the second end portion 37 of a fishplate 35 is a receiving opening 40 for engagement of a round pin 41 which is mounted underneath the support plates 11, 12. The pin 41 provides an additional stiffening of the divider barrier 1 against a lateral displacement transversely to the longitudinal direction of the divider barrier 1.

The pins 41 are each secured by a screw bolt 44 which is guided from the topside 42 of the support plate 11, 12 through an opening 43 in the support plate 11, 12 and is braced with the support plate 11, 12 (FIG. 3).

Figure 10:
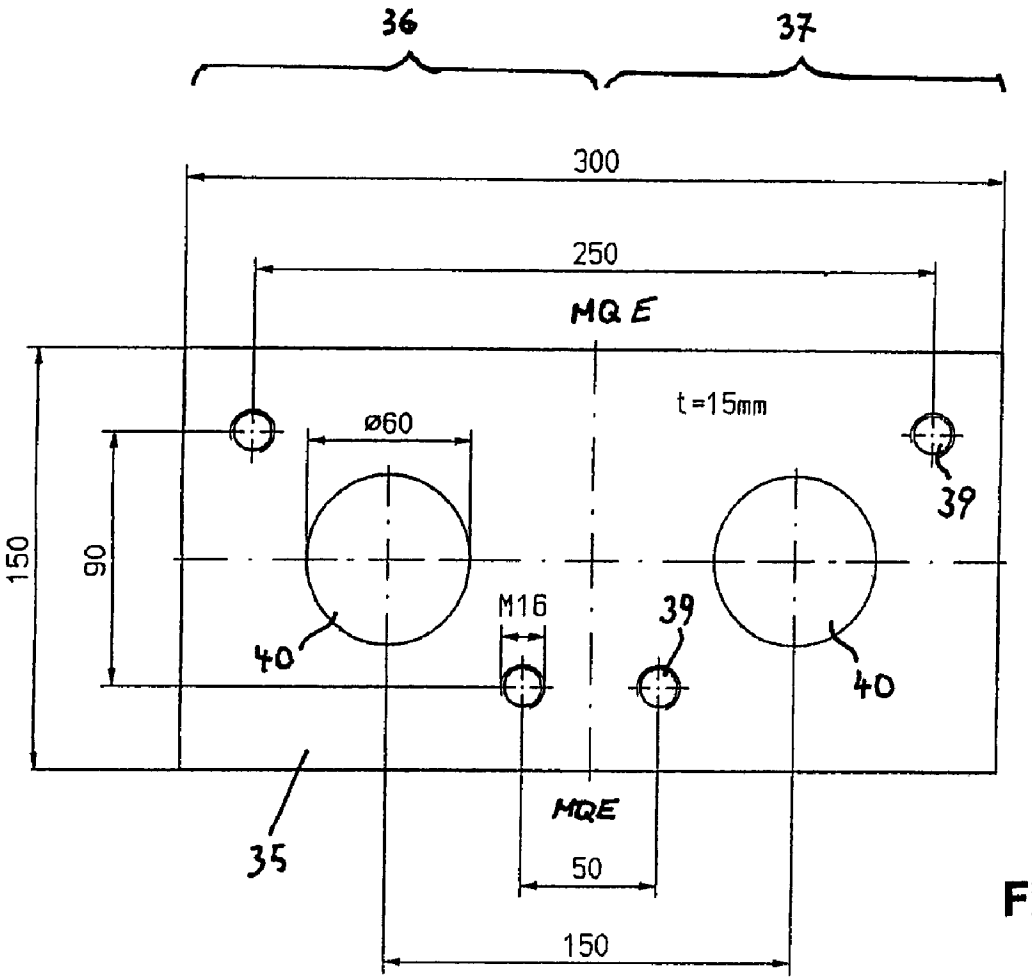
FIG. 10 a plan view of a fishplate.

As can be seen especially from FIG. 10, the fishplates 35 are configured in symmetric relationship to their center transversal plane MQE. This has advantages as far as fabrication and assembly are concerned. In particular, a fishplate 35 can be mounted on each side of a divider member 2, 3, 4, regardless of the respective installation position.

Suitably, the pins 41 are constructed in the form of a cone section and taper slightly downwards from the support plate. Thus, the pins 41 can easily be inserted in the receiving opening.

When assembled, the pins 41 engage in the receiving opening 40 of the fishplates 35. Accordingly, the diameter $D_Z$ of the pin 41 is configured to conform to the diameter $D_A$ of the receiving opening 40.

Figure 11:
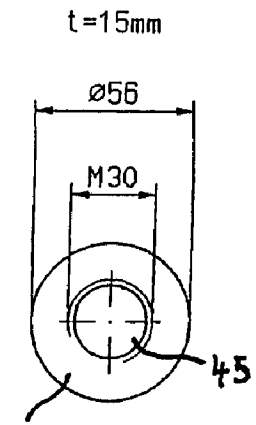
FIG. 11 also a plan view of a pin.

FIGS. 10 and 11 show an embodiment of a fishplate 35 and a pin 41 as intended for actual use with indication of concrete dimensions. As can be seen from the illustrations, the diameter $D_A$ of the receiving openings 40 equals 60 mm, while the diameter $D_Z$ of the pin 41 is selected to be 56 mm. Provided centrally in the pin 41 is a threaded bore 45 for receiving the screw bolt 44 which has a thread according to class M 30. The thickness t of the fishplate 35 as well as the thickness t of the pin amounts to 15 mm. The assembly openings 39 for securement of the fishplates 35 upon the support plates 11, 12 are designed as threaded bores M 16.

The diameter $D_A$ of the receiving openings 40 is greater than the diameter $D_Z$ of the pins 41. This measure enables a limited angled disposition between two successive divider members. The difference in diameter between the receiving openings 40 and the pins 41 may, of course, be selected even greater, for example 10 mm, in order to attain an even higher curve configuration. In these cases, the assembly openings 39 in the fishplates 35 are selected greater than the diameter of the screw fasteners 38 to be inserted therein so that the desired relative movement between the components is ensured.

Figure 12:
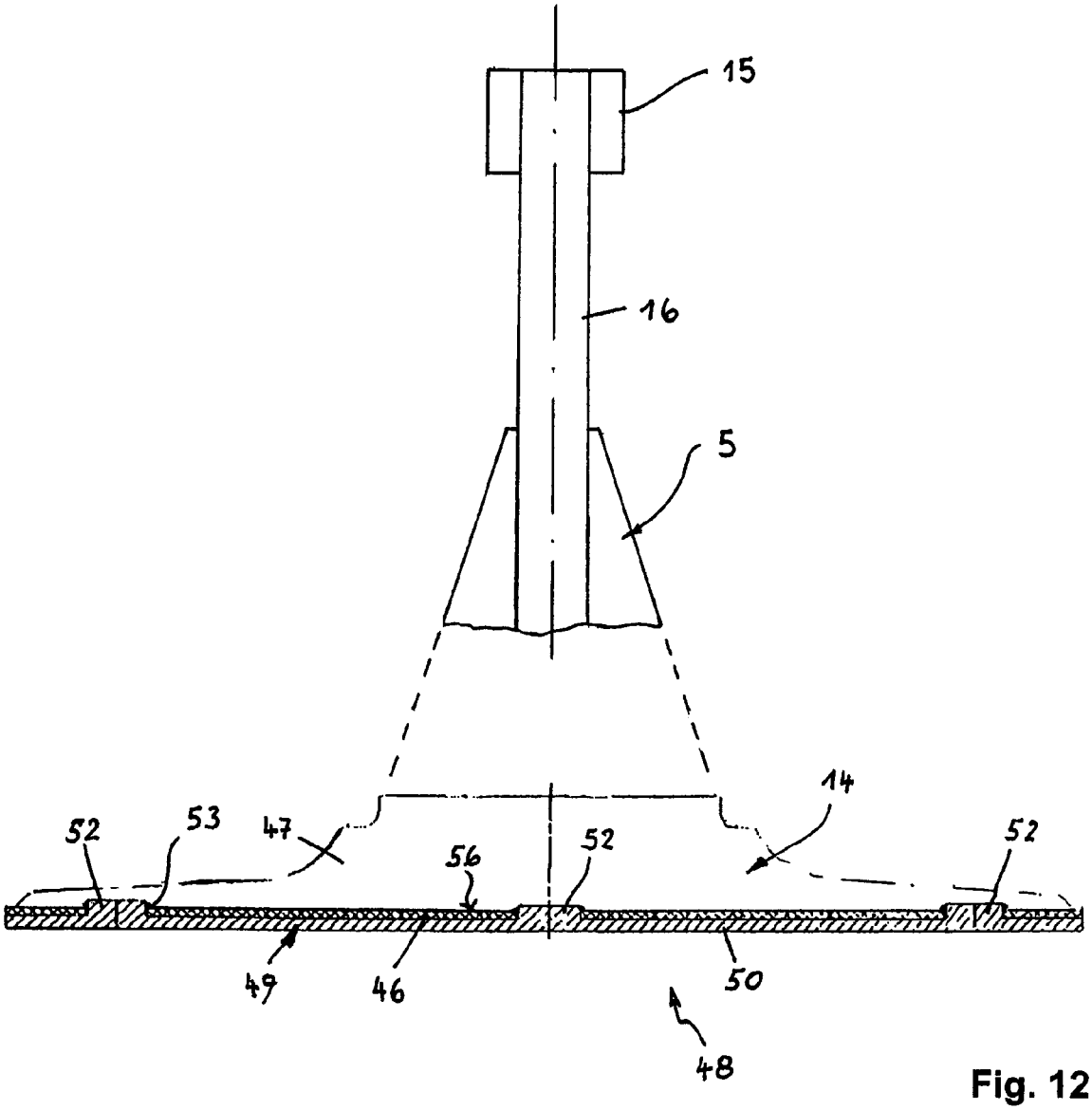
FIG. 12 a schematic illustration of a divider member with a vertical longitudinal section through the bottom-side stringer.

FIG. 12 shows a bottom-side stringer 14 of a divider member 2, shown only schematically and forming part of a divider barrier comprised of several such divider member 2.

Constructively, the divider member 2 corresponds to the afore-described embodiment so that corresponding parts or components are provided with same reference character.

The base body 5 is placed, as described above, via stringers 14 on the ground.

A stringer has a U-shaped cross section with a horizontal bottom plate 46 and vertically upwardly directed side walls 47.

The stringer 14 is provided with friction-increasing means 48, as this is also illustrated in FIG. 6. The friction-increasing means 48 are formed by a single-piece shoe 49 of elastomer which embraces the stringer 14 formfittingly from below. Preferably, the shoe 49 is made of rubber or molded polyurethane. The used material has a composition so prepared that the shoe 49 exhibits a high mechanical strength and wear-resistance. The coefficient of friction of the shoe 49 ensures high resistance against transverse displacement. Further, the show 49 is resistant against fuels, grease and oils as well as salts or similar environmental impacts. The shoe shields heat conduction from the divider member 2 via the stringer 14 to the road pavement or reduces it to a safe temperature level. A disadvantageous heat transfer and heating of the road surface is thus avoided.

Figure 13:
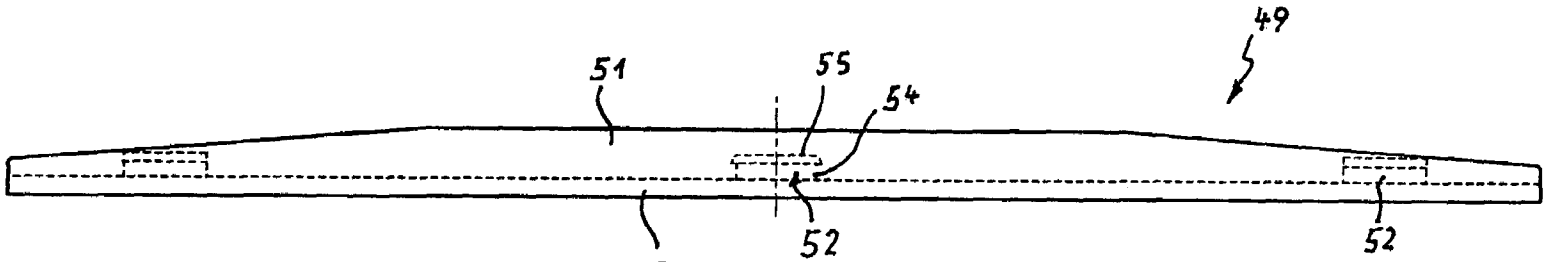
FIG. 13 a side view of a shoe secured underneath a base body of a divider member to the stringer thereof.
Figure 14:
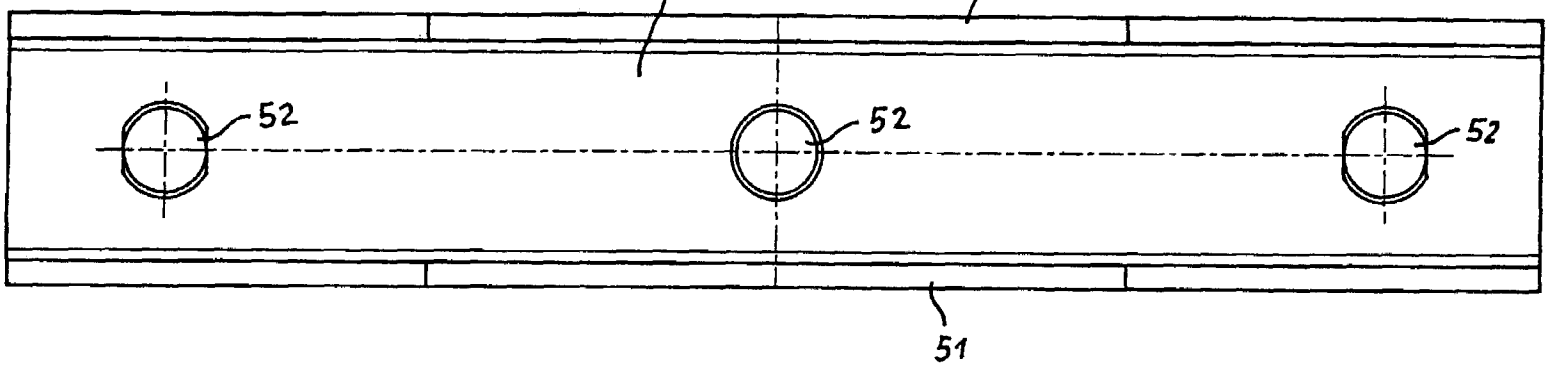
FIG. 14 a plan view of the shoe according to FIG. 13.
Figure 15:
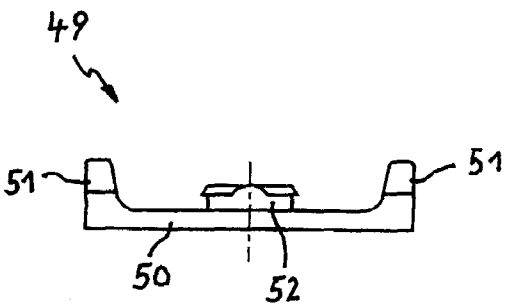
FIG. 15 an end view of the shoe.

The shoe 49 is configured with a U-shaped cross section and has a base plate 50, which carries the bottom plate 46, and side arms 51 which embrace the stringer 14 (see FIGS. 13 to 15). Formed on the shoe in one piece therewith are locking pegs 52 which engage in bores 53 of the bottom plate 46 (see also FIG. 8). As shown in particular in FIGS. 13 and 15, the locking pegs 52 have a mushroom-like configuration and have a shaft 54 and a wider head portion 55. The locking pegs 52 can be inserted or hammered into the bores 53 using their head portions 55 as abutment upon the top side 56 of the bottom plate 46. In this way, a safe and reliable securement of the shoe 49 upon the stringer 14 is ensured. The safe retention of the stringer 14 is stabilized by the side arms 51 of the shoe 49.

An essential advantage of the shoe 49 disposed underneath the stringers 14 is the increase in friction between the divider member 2 and the road surface, thereby contributing to an appreciable increase in transverse stiffness of the divider barrier 1. As a result, safety against a lateral displacement is enhanced in the event of an impact.

What is claimed is:

1. A divider barrier for roadway delineation, comprising:

plural divider members detachably connected to one another end-to-end, each divider member having a base body which is defined by opposite ends and includes slanted lateral collision plates having lower longitudinal edges, support plates connected to the lower longitudinal edges of the collision plates and extending from the base body outwards, and a guide bar defined by opposite ends, said guide bar extending above the base body at a vertical distance thereto and connected to the base body via vertical posts; and connecting means provided at the ends of the base body and the ends of the guide bar for attachment to neighboring base bodies and guide bars, wherein the support plates of successive divider members are detachably connected to one another by means of fishplates, with each fishplate having a first end portion disposed under the support plate of one divider member and including an assembly opening for receiving a screw fastener, and a second end portion disposed under the support plate of a neighboring divider member and including an assembly opening for receiving a screw fastener, wherein each of the first end portion and the second end portion of the fishplate has a receiving opening for engagement of a pin which is secured to the underside of each of the support plates for added stiffeness to prevent a lateral displacement of adjacent divider members, wherein the receiving opening and the assembly opening in each of the first end portions are of different size;

wherein the receiving opening of each of the first and second end portions is disposed centrally, with the assembly opening disposed eccentrically.

2. The divider barrier of claim 1, wherein the pin is constructed round.

3. The divider barrier of claim 1, wherein the pin is constructed in the form of a cone section.

4. The divider barrier of claim 1, wherein the fishplate is defined by a center transverse plane and constructed in symmetric relationship to the center transverse plane.

5. The divider barrier of claim 1, wherein the pin is secured in the receiving opening by a screw bolt which is guided from a topside of the support plate through an opening in the support plate into a threaded bore of the pin.

6. The divider barrier of claim 1, wherein the receiving opening has a diameter which is greater than a diameter of the pin to provide a limited angled disposition between two successive divider members.

7. The divider barrier of claim 1, further comprising friction-increasing means provided on an underside of the base body.

8. The divider barrier of claim 7, wherein the friction-increasing means are constructed in the form of a shoe which is made of elastomer and embraces stringers provided on the underside of the base body.

9. The divider barrier of claim 7, wherein the elastomer is rubber or polyurethane.

10. The divider barrier of claim 1, wherein the receiving opening has a size greater than the assembly opening.

11. The divider barrier of claim 1, wherein each of the first and second end portions has two of said assembly openings disposed on opposite sides of the receiving opening.

* * * * *